US005952794A

United States Patent [19]

Bergman et al.

[11] Patent Number: 5,952,794

[45] Date of Patent: Sep. 14, 1999

[54] METHOD OF SAMPLING AN ELECTRICAL LAMP PARAMETER FOR DETECTING ARC INSTABILITIES

[75] Inventors: Anthonie H. Bergman, Eindhoven, Netherlands; Phuong T. Huynh, McClean, Va.

[73] Assignee: Phillips Electronics North America Corportion, New York, N.Y.

[21] Appl. No.: 08/942,893

[22] Filed: Oct. 2, 1997

[51] Int. Cl.[6] ..... G05F 1/00

[52] U.S. Cl. ..... 315/307; 315/291; 315/224; 315/151

[58] Field of Search ..... 315/291, 307, 315/151, 244, 129, 224, 225, DIG. 4

[56] References Cited

U.S. PATENT DOCUMENTS

| | | | |
|---|---|---|---|
| 3,904,922 | 9/1975 | Webb et al. | 315/151 |
| 5,481,162 | 1/1996 | Boenigk et al. . | |
| 5,485,061 | 1/1996 | Utika et al. . | |
| 5,569,984 | 10/1996 | Holtslag . | |
| 5,663,613 | 9/1997 | Yamashita et al. | 315/307 |
| 5,710,488 | 1/1998 | Nilssen | 315/291 |
| 5,859,505 | 1/1999 | Bergman et al. | 315/291 |

FOREIGN PATENT DOCUMENTS

| | | | |
|---|---|---|---|
| 0708579A1 | 4/1996 | European Pat. Off. | H05B 41/29 |
| 4277495 | 10/1992 | Japan | H05B 41/24 |
| 4294095 | 10/1992 | Japan | H05B 41/24 |

OTHER PUBLICATIONS

"An Autotracking System for Stable Hf Operation of HID Lamps", F. Bernitz, Symp. Light Sources, Karlsrihe, 1986.

"Acoustic Resonances in Cylindrical High–Pressure Arc Discharges", by H.L. Witting, J. Appl. Phys. 49(5), May 1978, pp. 2680–2683.

Journal of the Ulluminating Engineering Society, Summer, 1991, pp. 95–96.

"Acoustic Resonance Phenomena in Low Wattage Metal Halide Lamps", by J.M. Davenport et al, Journal of IES, Apr. 1985, pp. 633–641.

"Study of HID Lamps With Reduced Acoustic Resonances", by S. Wada et al, Journal of the Illuminating Engineering Society, Winter, 1987, pp. 166–174.

"Acoustic Resonances in High Frequency Operated Low Wattage Metal Halide Lamps", by J.W. Denneman, Philips Journal of Research, vol. 38, Nos. 4/5, 1983, pp. 263–272.

*Primary Examiner*—Don Wong
*Assistant Examiner*—Wilson Lee
*Attorney, Agent, or Firm*—Brian J. Wieghaus

[57] ABSTRACT

A method and circuit for detecting arc instabilities in a high pressure gas discharge lamp. The method and circuit rectify and low pass filter the lamp voltage to obtain a quasi-rms voltage having recurrent periods with first zones containing spurious noise from switching of inverter switches and broad second zones, between the first zones, which are substantially free of spurious noise. The quasi-rms voltage is sampled only during the second zones, so that the samples have a high information-to-noise ratio. The sample signal may be used in a variety of methods to detect and control arc instabilities in gas discharge lamps.

16 Claims, 3 Drawing Sheets

METHOD OF SAMPLING AN ELECTRICAL LAMP PARAMETER FOR DETECTING ARC INSTABILITIES

CROSS-REFERENCE TO RELATED APPLICATIONS

This application relates to U.S. application Ser. No. 08/942,947 now U.S. Pat. No. 5,859,505, filed concurrently herewith, of Anthonie H. Bergman and Phuong T. Huynh, entitled "METHOD AND CONTROLLER FOR OPERATING A HIGH PRESSURE GAS DISCHARGE LAMP AT HIGH FREQUENCIES TO AVOID ARC INSTABILITIES", which discloses and claims a variable duration method of selecting frequencies to avoid arc instabilities.

BACKGROUND OF THE INVENTION

1. Field of the Invention

The invention relates to a method of sampling an electrical lamp parameter of a high pressure gas discharge lamp operating at high frequencies. The invention also relates to a circuit for sensing the electrical lamp parameter according to this method.

2. Description of the Prior Art

High pressure discharge (HID) lamps, such as mercury vapor, metal halide and high pressure sodium lamps, are typically operated with a magnetic ballast at or slightly above normal power line frequencies, e.g. 60–100 Hz. It would be desirable to provide an electronic ballast which operates HID lamps at high frequencies at above about 20 kHz. High frequency ballasts are becoming increasingly popular for low pressure mercury vapor fluorescent lamps. The high frequency operation permits the magnetic elements of the ballast to be reduced greatly in size and weight as compared to a conventional low frequency magnetic ballast.

A major obstacle to the use of high frequency electronic ballasts for HID lamps, however, is the acoustic resonances/arc instabilities which can occur at high frequency operation. Acoustic resonances, at the minimum, cause flicker of the arc which is very annoying to humans. In the worst case, acoustic resonance can cause the discharge arc to extinguish, or even worse, stay permanently deflected against and damage the wall of the discharge vessel, which will cause the discharge vessel to rupture.

The article "An Autotracking System for Stable Hf Operation of HID Lamps", F. Bernitz, Symp. Light Sources, Karlsruhe 1986, discloses a controller which continuously varies the lamp operating frequency about a center frequency over a sweep range. The sweep frequency is the frequency at which the operating frequency is repeated through the sweep range. The controller senses lamp voltage to evaluate arc instabilities. A control signal is derived from the sensed lamp voltage to vary the sweep frequency between 100 Hz and some Khz to achieve stable operation. However, this system has never been commercialized.

U.S. Pat. No. 5,569,984 (Holstlag) discloses a method of avoiding arc instabilities by evaluating deviations in an electrical parameter of the lamp. In Holstlag, frequency sweeps are used to detect a stable operating frequency, but the lamp is then operated at a fixed frequency as long as the discharge arc remains stable at that frequency. This is in contrast to the method of the above-referenced Bernitz article, which continuously sweeps the lamp operating frequency during operation.

Both techniques have in common that an electrical parameter of the lamp is sensed. Holstlag '984 teaches that lamp voltage can be used, but that this has the disadvantage that the sampling moment must be triggered at a definite point within the lamp voltage waveform. Holstlag teaches that sensing the conductivity is favorable, as having a much higher signal-to-noise ratio than either the lamp current or voltage alone. Holstlag further teaches that using the lamp conductivity is favorable, at least from the standpoint of not requiring triggering at a definite point in the period of the lamp voltage. When using conductivity, the lamp voltage and current need to be taken simultaneously, in order for the noise in the signal to cancel, but the simultaneous sample need not be keyed to a particular point in the lamp voltage period.

SUMMARY OF THE INVENTION

It is an object of the invention to provide an improved method of sampling an electrical lamp parameter useful for detecting arc instabilities in gas discharge lamps, which is widely applicable to lamps of different power, type, dimension, or physical or chemical composition.

It is another object to provide such a method which may be implemented in a wide range of ballast topologies.

It is still another object to provide a lamp controller, or ballast, which implements this method.

Generally speaking, the method according to the invention detects movement in a discharge arc of a discharge lamp operated at high frequency with a ballast circuit having at least one switch periodically switched at high frequency during lamp operation and wherein the lamp voltage is sinusoidal and has a fundamental period with a first portion having a first polarity corresponding to switching of said at least one switch and a second portion with a second polarity opposite to the first polarity. The method includes the steps of sensing the AC lamp voltage across the gas discharge lamp, and filtering the lamp voltage with a low pass filter such that the filtered lamp voltage includes (i) first, periodically occurring zones having spurious noise from the switching of said switch and (ii) second zones, between said first zones, said second zones being substantially free, relative to said first zones, of spurious noise from said switches of said DC/AC converter. The filtered lamp voltage is sampled only within said second zones.

According to a favorable embodiment, the sampling within the second zones is sampled at a fixed time after the switching of the at least one switch. This may be conveniently done by using as a trigger a switching signal used to control switching of the switch, the sample being taken at a fixed time after the occurrence of the trigger signal. The use of a fixed time has the advantage of a simple algorithm, while the use of the switching signal makes use of a signal already present in commercial ballasts.

Favorably, prior to filtering the AC lamp voltage is rectified to obtain a rectified lamp voltage signal having only signal portions with only one polarity.

According to another embodiment, the lamp voltage is reduced in magnitude prior to rectifying and filtering, to reduce component cost.

The invention also concerns a detection circuit useful in a lamp ballast to detect arc instabilities according to such method and to ballast including such a detection circuit.

These and other object, features and advantages of the invention will become apparent with reference to the following detailed description and the drawings, which are illustrative only and not limiting.

BRIEF DESCRIPTION OF THE DRAWINGS

FIG. 2(*b*) is a graph of quasi-RMS voltage for the same 39 W CDM lamp sampled according to the method of this invention;

DETAILED DESCRIPTION OF THE PREFERRED EMBODIMENTS

Figure 1:
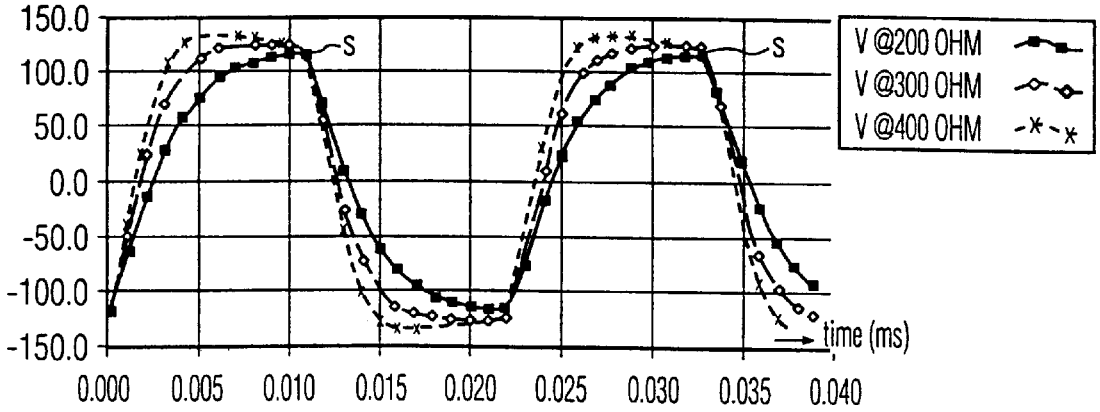
FIG. 1 is a graph illustrating the change in lamp voltage due to changes in resistivity, such as would occur with arc instability.

The above-mentioned U.S. patent (Holstlag '984), herein incorporated by reference, discloses a lamp ballast or controller which detects arc instabilities by examining deviations in an electrical parameter of the lamp. With reference to FIG. 13 of the '984 patent, the lamp controller includes a DC source 10, a boost converter 20, (also generally known as a pre-conditioner) a high frequency DC-AC square wave inverter 30 and an ignitor 40. A controller C includes a microprocessor 100 which is programmable with software to control the operation of the inverter 30, sense a lamp parameter and adjust the operating frequency to avoid acoustic resonance.

Instead of sampling conductivity, the lamp voltage or current alone may be sampled, which are both also effected by arc motion. The drawback of using current alone will be discussed later in this specification. However, in order to get a standard deviation comparable to $\sigma(G)$, the voltage data has to be sampled carefully, since the voltage data has a lower signal-to-noise ratio than the conductivity. The voltage sampling needs to be triggered so that it occurs at the same point in the period of the lamp voltage signal, otherwise the sinewave shape will make the signal look unstable no matter what the lamp situation is. Triggering can be done relatively easily, as the trigger signal is already available in the form of the drive signal for the switches of the DC-AC inverter 30. Secondly good timing can make the signal-to-noise ratio much better. Actually, what is important is the information-to-noise ratio. The best place to take a sample is the phase of the waveform where the biggest deviation occurs when the arc begins to move.

When the arc moves the resistivity increases. To determine the best phase of the voltage waveform to get the best information-to-noise ratio, a measurement was done using simple resistors as a first order approximation of arc motion. With a half bridge and an LCC ignitor, three waveforms were taken using respectively 200, 300 and 400Ω resistors. These waveforms are shown in FIG. 1. The moments that the inverter's switches switch are labeled "S". Clearly, the best moment to sample does noes not coincide with the moment the switches switch, as the voltage for all three curves is substantially the same at that point (e.g., at 11 $\mu$s). Therefore a delay time with respect to the switching point of the switches is necessary. Without more, a fixed delay time is not suitable, since during lamp operation, the lamp operating frequency will change to avoid arc instabilities, such as caused by acoustic resonance. In order to sample at the same phase for each frequency the delay time becomes a function of frequency. However, having a delay time which varies with frequency would require additional circuitry and/or software and or a more expensive micro-controller, and generally implies a higher cost ballast.

In order to circumvent the necessity for a sampling scheme which is frequency dependent, the method according to the invention converts the lamp voltage to a 'quasi RMS voltage'. The lamp voltage amplitude is first lowered using a simple resistive voltage divider. Subsequently this low voltage is rectified and filtered, to give the 'quasi RMS voltage'. By a 'quasi-RMS voltage' is meant a DC voltage representative of an AC signal. The choice of the cut-off frequency for the filter is very important. Generally, the cut-off frequency is related to the response time necessary to detect and react to arc motions to prevent the lamp from extinguishing. The cut-off frequency must be low enough so that the high frequency signals (35 to 40 KHz) at which the inverter drives the lamp is sufficiently attenuated to allow accurate detection of arc motions from the sampled lamp voltage signal. The cut-off frequency may not be too low otherwise lamp changes will be detected too slowly. On the other hand, if the frequency is too high the signal does not get filtered. Cut-off frequencies of 2 kHz and 5 kHz have been found to be acceptable for a 39 W CDM lamp.

Figure 2A:
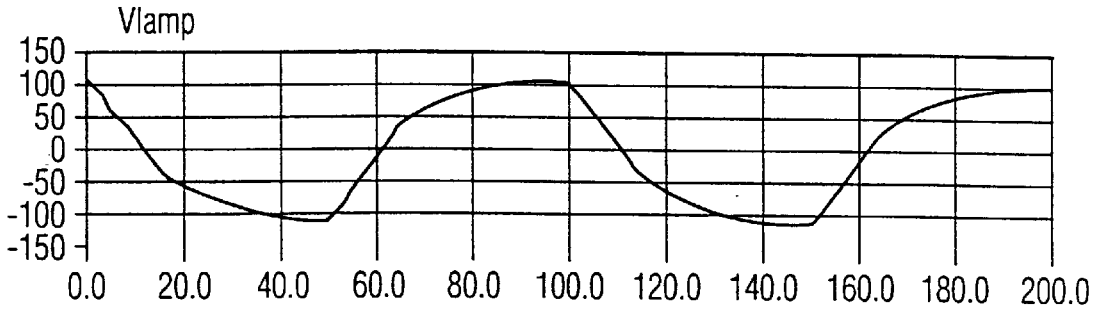
FIG. 2(*a*) is a graph of lamp voltage for a 39 W CDM lamp.
Figure 2B:
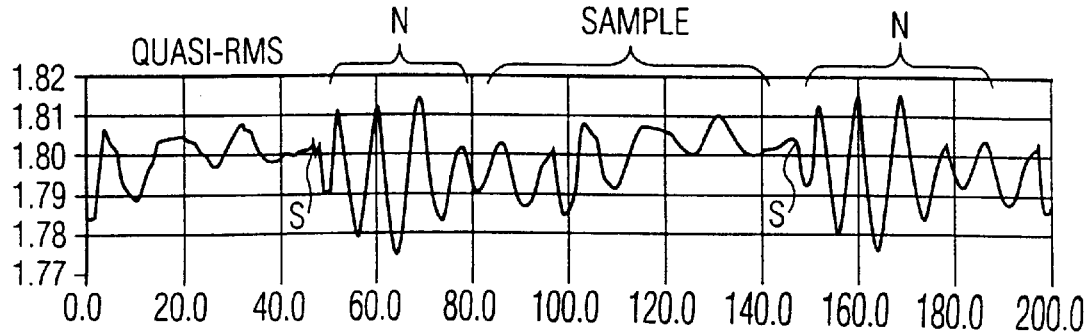

FIG. 2(*a*) is a graph of lamp voltage ($V_{LAMP}$) for a 39 W CDM (ceramic discharge vessel) lamp while FIG. 2(*b*) shows the corresponding quasi-RMS voltage $V_{quasi\text{-}RMS}$. In FIG. 2(*b*), the switching points are labeled "S". FIG. 2(*b*) shows that in the vicinity of these switching points, the quasi-RMS voltage has a region of spurious noise, labeled "N", caused by the switching of the inverter switches. In these regions "N", it would not be favorable to sample in order to obtain a high information-to-noise ratio. However, between these regions of spurious noise are relatively noise-free zones, labeled "sample", in which samples with a relatively high information-to-noise ratio may be obtained. Note that the excursions in the "sample" zones are small, in view of the much reduced voltage scale of FIG. 2(*b*) as compared to FIG. 2(*a*).

Because of the relatively wide "sample" zone in the quasi RMS voltage, samples may be taken anywhere in this zone. This gives considerable tolerance to the triggering of the sample. Thus, a fixed delay time may be used to trigger the sampling of the quasi-RMS voltage by the microprocessor and, despite reasonable changes in the operating frequency to avoid acoustic resonance, the sample will still occur within the relatively wide "sample" zone. Thus, fixed-time triggering can be used, which simplifies signal processing, allowing a lower cost microprocessor. This is in contrast to the case where lamp voltage is sampled directly, which requires a delay time that varies with frequency.

Figure 3:
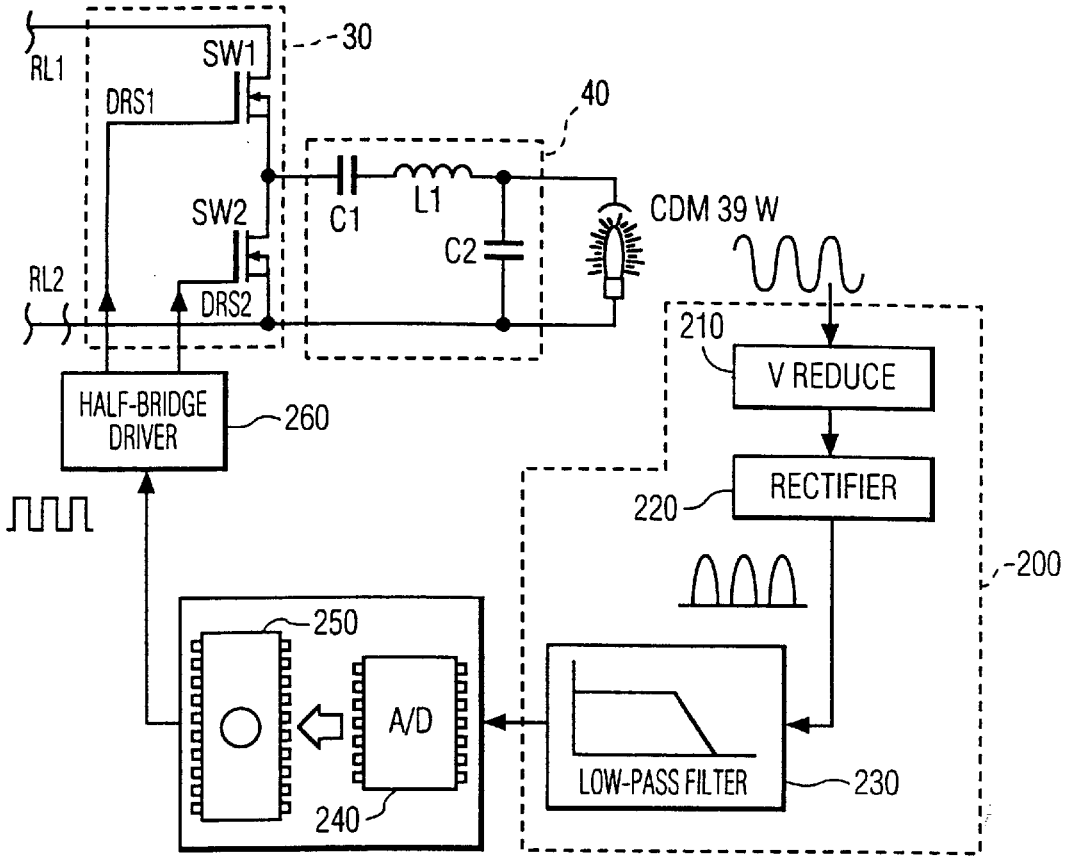
FIG. 3 is a schematic illustration of a portion of a ballast indicating the circuit blocks for converting the lamp voltage into a quasi-RMS voltage according to the invention.

FIG. 3 schematically illustrates the sensing of a quasi-RMS lamp voltage in a ballast for determining arc instabilities. For purposes of clarity, the front end of the ballast is not shown, but is understood to include a DC source for converting AC power line to 120 Hz DC and a pre-conditioner (also known as an up-converter) for supplying a DC voltage to the DC-AC inverter 30, as illustrated for example in the '984 Holstlag patent. In FIG. 9, the ignitor 40 is an LCC ignitor formed by capacitors C6, C7 and inductor L2. The DC-AC inverter includes switches Q1, Q2 driven by drive signals DRS1, DRS2 at the control gates of switches Q1, Q2. As further illustrated, the sinusoidal lamp voltage across the lamp is sensed and reduced in amplitude (block 210), half-bridge rectified (block 220) and filtered (block 230) with a low pass filter, all in block 200. The output of the low pass filter 230 is the quasi-RMS voltage, which is input to an A/D converter 240 which converts the quasi-RMS voltage to a digital signal. This digital signal is input to a micro-controller 250, which implements the steps of any suitable control method in software. The output of the micro controller is a square wave signal input to a half-bridge driver 260 which provides the switching signals DRS1, DRS2 to the half-bridge switches Q1, Q2. The A/D converter may be an Analog Devices ADC0820, the microcontroller a Philips 40 MHZ 87C750, and the half bridge driver an IR 2111 from International Rectifier.

Figure 4:
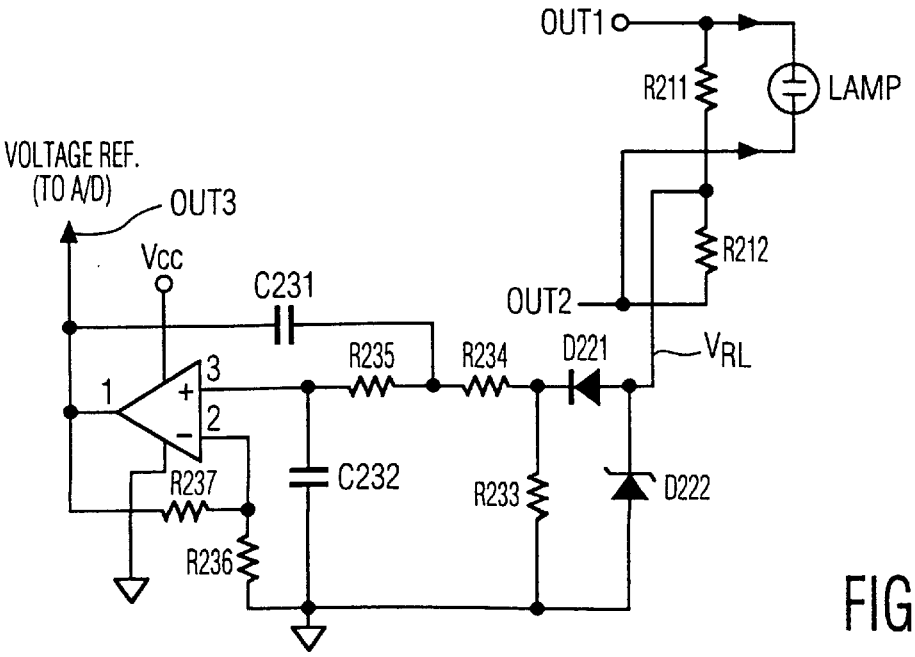
FIG. 4 is a circuit diagram implementing the voltage conversion blocks of FIG. 3.

FIG. 4 shows a circuit for carrying out the functions of block 200. The lamp voltage is sensed at the ballast output terminals OUT1, OUT2 and reduced in magnitude by a voltage divider including the resistors R211, R212. This reduced lamp voltage $V_{RL}$ is then rectified with diode D221. The diode D222 is a zener diode for protecting against transients. The filter 230 shown in this implementation is a second order low pass Chebyshev filter. The filter includes op amp OA1 having its inverting input connected to ground through resistor R236 and its non-inverting input connected to the cathode of diode D221 through the resistors R233, R234. The resistor R233 provides further attenuation of the amplitude of the sensed lamp voltage, and is connected between ground and a node between the diode D221 and the resistor R234. The capacitor C232 is connected between ground and a node between the resistor R235 and the non-inverting input of the op amp OA1. The output OUT3 of filter 126 is connected to the output of op amp OA1 and one end of the capacitor C231, the other end of which is connected to a node between the resistors R233 and R234. A selected cut-off frequency for the Chebyshev filter is implemented in a well known manner by selection of values for the resistors R236, R237, R234, R235 and capacitor C231 and C232.

A commercial ballast operating off of a standard utility line will be implemented using a preconditioner, that is, power factor correction circuit. In practice, this means that the DC voltage supplied to the bridge ($V_{bus}$) will have a substantial 120 Hz (for Europe 100 Hz) ripple component. This ripple component will propagate through the LCC network and appear across the lamp terminals and modulate the high frequency envelope of the lamp voltage and current. The quasi RMS voltage will also be effected as the cut-off frequency of the low pass filter is much higher than 120 Hz.

Figure 5:
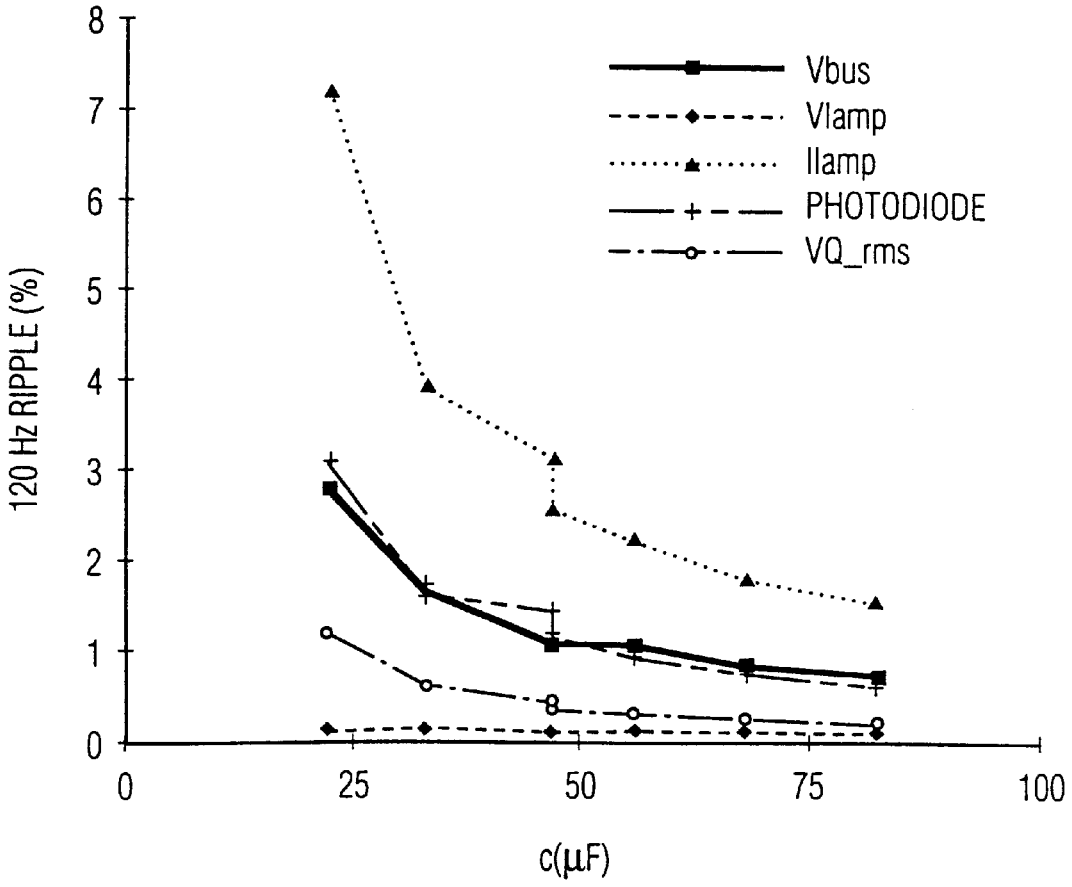
FIG. 5 is a graph illustrating ripple as a function of a ballast storage capacitor for various lamp parameters.

The consequences of the ripple component on lamp voltage and current are different, as illustrated in FIG. 5. In this FIG. 5 the thick line represents the bus voltage and shows the ripple component decreasing with increased storage capacitance. The lamp intensity (the dotted-dashed line behind the thick line) follows this ripple closely. FIG. 5 also clearly shows that, even at low "C" values, the lamp is capable of maintaining constant voltage, whereas the lamp current has a very large ripple. This is in agreement with the voltage source characteristic of a HID lamp and has a very important consequence. The relatively large current ripple makes it more favorable to use the quasi-RMS voltage than the conductivity as the important signal to determine arc stability, thereby avoiding the effects of current ripple which would be present in the conductivity.

The amplitude of this component is strongly determined by the value of the storage/ripple-filter capacitor of the preconditioner. A control algorithm for detecting arc instabilities should not confuse a change caused by this ripple with lamp instability. Consequently, a large storage capacitor should be selected to attenuate this ripple. The best performance is obtained when the ripple is below the resolution of the A/D converter 240. Since price and size of the storage capacitor go up with its value, there is a trade-off between selecting a large storage capacitor for optimum detector performance versus cost and size of the ballast. For each ballast, testing can determine the optimum of the storage capacitor. 33 $\mu$F and 47 $\mu$F storage capacitors were found to provide acceptable results for a 39 W CDM lamp.

The sampling method according to the invention is advantageous with respect to conductivity because only the voltage needs to be sampled. This reduces cost by eliminating the need for an A/D converter for the current signal. Additionally, the quasi-RMS voltage is influenced much less by the 120 Hz ripple than the conductivity which includes the lamp current, shown in FIG. 5 to be influenced by the lamp current.

The disclosed quasi-RMS signal is also highly frequency independent, allowing a simpler sampling scheme.

While there have been shown what are considered to be the preferred embodiments of the invention, those of orindary skill in the art will appreciate that various modifications may be made in the above described method and lamp controller which are within the scope of the appended claims. Accordingly, the specification is illustrative only and not limiting.

What is claimed is:

1. A method of detecting movement in a discharge arc of a discharge lamp operated at high frequency with a ballast circuit having at least one switch periodically switched during lamp operation, said method including recurrently sensing an electrical lamp parameter of the lamp, characterized by comprising the steps of:

sensing the AC lamp voltage across the gas discharge lamp, the lamp voltage being sinusoidal and having a fundamental period with a first portion having a first polarity corresponding to switching of said at least one switch and a second portion with a second polarity opposite to the first polarity;

filtering the lamp voltage with a low pass filter such that the filtered lamp voltage includes (i) first, periodically occurring zones having spurious noise from the switching of said switch and (ii) second zones, between said first zones, said second zones being substantially free, relative to said first zones, of spurious noise from said switches of said DC/AC converter; and sampling the filtered, lamp voltage within said second zones.

2. A method according to claim 1, further comprising the step of reducing the magnitude of the lamp voltage.

3. A method according to claim 1, further comprising rectifying the AC lamp voltage to obtain a rectified lamp voltage signal having only signal portions with only said first polarity.

4. A method according to claim 1, wherein said sampling occurs at a fixed time after switching of the at least one switch.

5. A method according to claim 4, wherein for a ballast which further includes means generating a switching signal to switch the at least one switch, said method further comprising receiving the switching signal and sampling at a fixed time after receiving the switching signal.

6. A method according to claim 1, wherein said low pass filter has a cut-off frequency low enough to obtain a stable sampling signal while high enough to remain sensitive to detect arc motions.

7. A lamp ballast for operating a high pressure discharge lamp at high frequencies, said ballast comprising:

a DC source for providing a DC voltage;

a DC/AC inverter for converting said DC voltage to a high frequency AC voltage for maintaining a column discharge within the discharge lamp; and detection means for detecting arc instabilities in said discharge lamp, said detection means including (i) means for sensing the lamp voltage across said discharge lamp, the sensed lamp voltage being sinusoidal and having a fundamental period with a first portion having a first polarity and a second portion with a second polarity opposite to the first polarity; said DC/AC inverter including at least a pair of switches, each switched during a respective portion of the fundamental period of the lamp voltage;

(ii) means for filtering the lamp voltage with a low pass filter, said DC/AC inverter including at least one switch periodically switched during lamp operation, the filtered lamp voltage including first, periodically occurring zones having spurious noise from the switching of a respective switch of the DC/AC inverter and second zones, between said first zones, said first zones being substantially free, relative to said first zones, of spurious noise from said switches of said DC/AC converter, and (iii) means for sampling the filtered lamp voltage within said second zones.

8. A lamp ballast according to claim 1, wherein said detection means further comprises means for reducing the magnitude of the lamp voltage.

9. A lamp ballast according to claim 7, further comprising means for rectifying the AC lamp voltage to obtain a rectified lamp voltage signal having only portions of said fundamental period with only one of said first and second polarities.

10. A lamp ballast according to claim 7, wherein said means for sampling samples at a fixed time after switching of said at least one switch of said DC/AC inverter.

11. A lamp ballast according to claim 10, wherein said ballast further includes control means generating a switching signal to switch said at least one switch, said means for sampling receiving said switching signal and sampling at a fixed time after receiving said switching signal.

12. A lamp ballast according to claim 7, wherein said low pass filter has a cut-off frequency low enough to obtain a stable sampling signal while high enough to remain sensitive to detect arc motions.

13. A detection circuit for detecting movement in the discharge arc of a gas discharge lamp, the discharge lamp having a lamp voltage and being drive by a DC/AC inverter, the sensed lamp voltage being sinusoidal and having a fundamental period with a first portion having a first polarity and a second portion with a second polarity opposite to the first polarity, said DC/AC inverter including at least a pair of switches, each switched during a respective portion of the fundamental period of the lamp voltage, said detection circuit comprising:

(i) means for sensing the lamp voltage across said discharge lamp, the sensed lamp voltage being sinusoidal and having a fundamental period with a first portion having a first polarity and a second portion with a second polarity opposite to the first polarity;

(ii) means for rectifying the AC lamp voltage to obtain a rectified lamp voltage signal having only portions of said fundamental period with only one of said first and second polarities;

(iii) means for filtering the rectified lamp voltage with a low pass filter, the DC/AC inverter including at least one switch periodically switched during lamp operation, the filtered rectified lamp voltage including first, periodically occurring zones having spurious noise from the switching of a respective switch of the DC/AC inverter and second zones, between said first zones, said first zones being substantially free, relative to said first zones, of spurious noise from said switches of said DC/AC converter; and (iv) means for sampling the filtered, rectified lamp voltage within said second zones.

14. A lamp ballast according to claim 13, wherein said detection means further comprises means for reducing the magnitude of the lamp voltage.

15. A lamp ballast according to claim 13, wherein said means for sampling samples at a fixed time after switching of said at least one switch of said DC/AC inverter.

16. A lamp ballast according to claim 15, wherein said ballast further includes control means generating a switching signal to switch said at least one switch, said means for sampling receiving said switching signal and sampling at a fixed time after receiving said switching signal.

* * * * *